United States Patent [19]

Delfino et al.

[11] Patent Number: 4,695,531

[45] Date of Patent: Sep. 22, 1987

[54] LIGHT-SENSITIVE ELEMENTS FOR RADIOGRAPHIC USE IN THE FORMATION OF AN X-RAY IMAGE

[75] Inventors: Gerolamo Delfino, Savona; Simone Franco, Ferrania; Cesare Verdi, Carcare, all of Italy

[73] Assignee: Minnesota Mining and Manufacturing Company, St. Paul, Minn.

[21] Appl. No.: 887,121

[22] Filed: Jul. 17, 1986

[30] Foreign Application Priority Data

Jul. 25, 1985 [IT] Italy ..... 21716 A/85

[51] Int. Cl.[4] ..... G03C 1/84

[52] U.S. Cl. ..... 430/513; 430/518; 430/523

[58] Field of Search ..... 430/513, 518, 523

[56] References Cited

U.S. PATENT DOCUMENTS

| | | | |
|---|---|---|---|
| 2,882,156 | 4/1959 | Minsk | 430/518 |
| 3,282,693 | 11/1966 | Jones et al. | 430/518 |
| 3,740,228 | 6/1973 | Ohlschlager et al. | 430/518 |

FOREIGN PATENT DOCUMENTS 0101295 2/1984 European Pat. Off. .

*Primary Examiner*—Jack P. Brammer

*Attorney, Agent, or Firm*—Donald M. Sell; James A. Smith; Mark A. Litman

[57] ABSTRACT

A light-sensitive silver halide element for radiographic use with intensifying screens has coated on at least one side of a transparent base at least a spectrally sensitized silver halide emulsion layer and, coated between the base and a silver halide emulsion layer, a hydrophilic colloid layer containing a water-soluble acid dye capable of being decolorized during the photographic processing, said dye having its absorption in a region of the electromagnetic spectrum corresponding to the spectral sensitivity of the silver halide emulsion, associated with a basic polymeric mordant which comprises repeating units of formula:

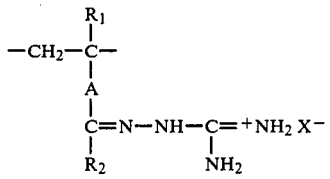

wherein $R_1$ is hydrogen or a methyl group, A is a —COO— or —COO—alkylene group, $R_2$ is hydrogen or a lower alkyl group and X is an anion.

The invention allows the use of low coverage weights of silver halide light-sensitive elements and provides x-ray images with a favorable image quality and sensitivity ratio.

13 Claims, No Drawings

LIGHT-SENSITIVE ELEMENTS FOR RADIOGRAPHIC USE IN THE FORMATION OF AN X-RAY IMAGE

FIELD OF THE INVENTION

The present invention refers to light-sensitive silver halide elements to be used in radiography and, more in particular, to light-sensitive silver halide elements to be used with intensifying screens to obtain improved x-ray images.

In radiography, and particularly in medical radiography, light-sensitive elements having silver halide emulsion layers coated on one side of a transparent base are used. It is known to be more preferable to use silver halide emulsions on both sides to obtain a better developability with respect to single-side coated elements. Light-sensitive elements having the silver halide emulsion layers coated on at least one and, more preferably, on both surfaces of the base are generally used in association with intensifying screens in order to reduce the x-ray exposure necessary to obtain the required image. Generally, one intensifying screen is used on each side of the light-sensitive element. The silver halides used in the light-sensitive elements are sensitized to a region of the electromagnetic spectrum corresponding to the wavelength of the light emitted by the luminescent materials used in the intensifying screens, thus obtaining significant amplification factors.

A disadvantage of such light-sensitive elements, which during exposure to x-rays have the silver halide emulsion layer in contact with the intensifying screen, is the so-called "cross-over" phenomenon.

This phenomenon results from the fact that the light emitted by the intensifying screen does not expose only the silver halide emulsion layer with which it is in contact, but is transmitted through the emulsion layer and the support up to expose the opposite emulsion layer. This light therefore undergoes a whole series of reflections and refractions. The resulting image has low definition.

The cross-over phenomenon stil causes poor definition even if light-sensitive elements are used which employ reduced silver halide coverages to lower the costs or increase the processing speed of the element. In fact, the decrease of the emulsion turbidity increases the amount of light available for cross-over and therefore worsens the image.

To reduce the cross-over phenomenon dyes or pigments can be used within the photographic element. The absorption of said dyes or pigments is in a region of the electromagnetic spectrum corresponding to the wavelength of the light emitted by the intensifying screens. The dyes or pigments absorb some of the light emitted by the intensifying screen so that imaging of the rear emulsion by the forward screen is reduced by absorbance of the light from the forward screen by the anticross-over layer. These dyes or pigments are eliminated during the photographic developing, fixing and washing process of the exposed material; they can be for instance washed away or, more preferably, bleached while processing the radiographic element.

The dyes can be incorporated in any layer of the light-sensitive element: in the emulsion layer, in an intermediate layer between the emulsion and the base, or in the base sublayer. It is preferred to incorporate the dyes in a layer different from that containing the emulsion to avoid possible desensitization phenomena. Since 1978 Minnesota Mining and Manufacturing Company has sold a radiographic element under the name of 3M Trimax TM Type XUD X-Ray Film to be used in combination with 3M Trimax TM Intensifying Screens. Such element comprises a transparent polyester base, each surface of which has a silver halide emulsion layer sensitized to the light emitted by the screens. Between the emulsion and the base is a gelatin layer containing water-soluble acid dyes, which dyes can be decolorized during processing and have an absorption in a region of the electromagnetic spectrum corresponding to the wavelength of the light emitted by the screens and of the spectral sensitivity of the emulsion. The dyes are anchored in the layer by means of a basic mordant consisting of polyvinylpyridine.

In the practical solution of reducing the cross-over phenomenon by using a mordanted dye layer (as described for instance in the European Patent Application No. 101,295), some problems are created which up to now have not yet been solved properly. In fact, the improvement of image definition involves not only a natural decrease of the light-sensitive element sensitivity caused by the absorption of the transmitted and diffused light which otherwise would take part in the formation of a part of the image, but also the possibility of desensitization phenomena due to the migration of dye not firmly mordanted in the silver halide emulsion layer. There is also a problem with residual stain even after processing, the retention of significant quantities of thiosulfate from the fixing bath which causes image yellowing upon long-time storage on shelf, and lengthening of the drying times after processing because of element thickening.

SUMMARY OF THE INVENTION

It is an object of the present invention to reduce the cross-over phenomenon in a silver halide x-ray element to be used with x-ray intensifying screens without thereby causing negative effects, such as desensitization, residual stain, image instability upon storage and excessive element thickening.

According to the present invention, these and other advantages are achieved by means of a light sensitive element to be used in radiography together with intensifying screens, which element comprises a transparent base having coated on at least one of its surfaces a silver halide emulsion layer spectrally sensitized to a region of the electromagnetic spectrum corresponding to the wavelength of the light emitted by the screens upon exposure to x-rays and, between the emulsion layer and the base, a hydrophilic colloidal layer containing a water-soluble acid dye, which can be decolorized during the photographic processing and whose absorption is in the region of the spectrum corresponding to the wavelength of the spectral sensitivity of the emulsion, mordanted with a basic polymeric mordant which includes repeating units of formula:

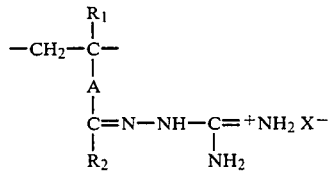

wherein $R_1$ is hydrogen or a methyl group, A is a —COO— or a —COO—alkylene group, $R_2$ is hydrogen or a lower alkyl group and X is an anion.

DETAILED DESCRIPTION OF THE INVENTION

The present invention refers to a silver halide light-sensitive element to be associated with x-ray intensifying screens and used in radiography.

The light-sensitive element comprises a polymeric base of the type commonly used in radiography, for instance a polyester base, in particular a polyethylene terephthalate base.

On at least one surface, preferably on both surfaces of the base there is coated a silver halide emulsion layer in a hydrophilic colloid. The emulsions coated on the two surfaces may also be different and comprise emulsions commonly used in photographic elements, such as silver chloride, silver iodide, silver chloro-bromide, silver chloro-bromo-iodide, silver bromide and silver bromo-iodide emulsions, the silver bromo-iodide emulsions being particularly useful for the x-ray elements. The silver halide crystals may have different shapes, for instance cubical, octahedrical, tabular shapes, and may have epitaxial growth; they generally have means sizes ranging from 0.1 to 3 micron, more preferably from 0.4 to 1.5 micron. The emulsions are coated on the base at a total silver coverage comprised in the range from about 3 to 6 grams per square meter. The silver halide binding material used is a water-permeable hydrophilic colloid, which preferably is gelatin, but other hydrophilic colloids, such as gelatin derivatives, albumin, polyvinyl alcohol, alginates, cellulose hydrolized esters, hydrophilic polyvinyl polymers, dextrans, polyacrylamides, acrylamide hydrophilic copolymers and alkylacrylates can also be used alone or in combination with gelatin.

The light-sensitive element according to the present invention is associated with the intensifying screens so as to be exposed to the radiations emitted by said screens. The screens are made of relatively thick phosphor layers which transform the x-rays into light radiation. The screens absorb a portion of x-rays much larger than the light-sensitive element and are used to reduce the radiation doses necessary to obtain a useful image. According to their chemical composition, the phosphors can emit radiations in the blue, green or red region of the visible spectrum and the silver halide emulsions are sensitized to the wavelength region of the light emitted by the screens. Sensitization is performed by using spectral sensitizers as well-known in the art. The x-ray intensifying screens used in the practice of the present invention are phosphor screens well-known in the art. The x-ray intensifying screens used in the practice of the present invention are phosphor screens well-known in the art. Particularly useful phosphors are the rare earth oxysulfides doped to control the wavelength of the emitted light and their own efficiency. Preferably are lanthanum, gadolinium and lutetium oxysulfides doped with trivalent terbium as described in U.S. Pat. No. 3,725,704. Among these phosphors, the preferred ones are gadolinium oxysulfides wherein from about 0.005% to about 8% by weight of the gadolinium ions are substituted with trivalent terbium ions, which upon excitation by UV radiations, x-rays, cathodic rays emit in the blue-green region of the spectrum with a main emission line around 544 nm. If screens based on such phosphors are used, the silver halide emulsions are spectrally sensitized to the spectral region of the light emitted by the screens, preferably to a spectral region of an internal comprised within 25 nm from the wavelength of maximum emission of the screen, more preferably within 15 nm, and most preferably within 10 nm. Many types and combinations of spectral sensitizers can be used. Specifical examples of dyes to be used in combination with screens emitting in the blue-green region of the visible spectrum include the sulfoalkyl-substituted oxacarbocyanines to be used alone or in a supersensitizing combination with cyanine benzothiazole, the imidazole carbocyanine and quinolino cyanine combinations and the imidazo-oxazole carbocyanine and oxazole sulfoalkyl-substituted merocyanine combinations.

According to the present invention, the light-sensitive element has a hydrophilic colloid layer containing a dye mordanted with the above specified polymeric mordant which is coated between the base and the silver halide emulsion layer.

Dyes useful in the present invention are the water-soluble dyes which absorb colors in a region of the electromagnetic spectrum corresponding to the spectral sensitivity region of the light-sensitive element and are capable of being decolorized during the photographic processing. The expression "capable of being decolorized" means that the capability of the dye to absorb the light emitted by the screens must be substantially decreased or, more preferably, eliminated completely. These are several methods in the photographic art for decolorizing a dye without destroying the image of the element; the dye can, for instance, be washed away from the material in the processing solutions, can be bleached in the alkaline solutions, can be bleached by means of heat, or can be bleached with the sulfite of the processing solution. To the purposes of the present invention, dyes are preferably used which can be bleached in the conventional developing and fixing solutions, as described in Photographic Chemistry, Vol. II, P. Glafkides, 1960, pages 703–704. Among the dyes which can be used with advantage according to the present invention there are those described for instance in U.S. Defensive Publication No. T-0904017 and U.S. Pat. Nos. 2,856,404 and 3,282,699.

The dyes useful in the present invention are acid dyes, i.e. dyes having their molecule substituted with at least one acid group of the sulfo, sulfoalkyl, sulfoaryl, carboxy, carboxyalkyl type or with various combinations of these groups. Said dyes are known water soluble dyes, the term "soluble" meaning soluble for at least 1% by weight and the term "water soluble" meaning soluble in water or in aqueous solutions such as aqueous alkaline solutions or aqueous/organic solvent solutions (as known in the art).

Representative examples of useful dyes correspond to the following formulas:

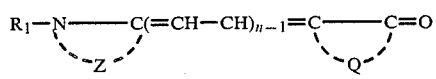

(I)

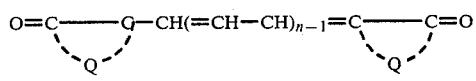

(II)

wherein $R_1$ represents an alkyl group such as methyl, ethyl, propyl, isopropyl, butyl, isobutyl, tertiary butyl, etc. or a carboxyalkyl group such as carboxymethyl, carboxyethyl, carboxypropyl, etc., or a sulfoalkyl group such as sulfoethyl, sulfopropyl, sulfobutyl, etc.; Z represents the non-metallic atoms necessary to complete a heterocyclic nucleus of the benzoxazole series, including benzoxazole and benzoxazole substituted for instance with methyl, ethyl, phenyl, methoxy, ethoxy groups, with chlorine, bromine, etc.; Q represents the non-metallic atoms necessary to complete a heterocyclic nucleus of the pyrazolidone series; n is a positive integer from 1 to 3, having their molecule substituted with at least a sulfo, sulfoalkyl, sulfoaryl, carboxy, carboxyalkyl group or with combinations of such groups.

The dyes of the present invention have absorption maxima in the spectral region of the light emitted by the phosphors contained by the intensifying screens, preferably within 25 nanometers from the wavelength of the emission maximum of the screens, more preferably within 10 nanometers from such wavelength.

In the most preferred from of the present invention, wherein the phosphors of the screens are the gadolinium oxysulfides doped with trivalent terbium ions which emit light radiation comprised in the blue-green region of the visible spectrum, particularly useful dyes are those represented by formula (I), wherein n is 3 and by formula (II) wherein n is 2.

Specific examples of dyes which absorb the spectral region of emission of the gadolinium oxysulfides doped with trivalent terbium ions are the following:

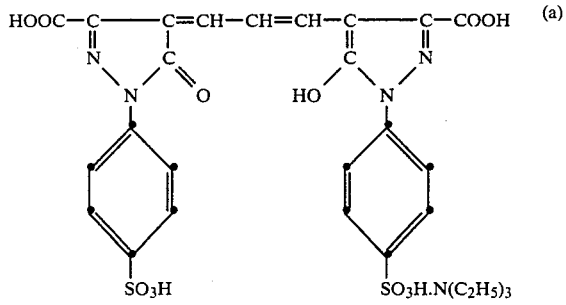

(a)

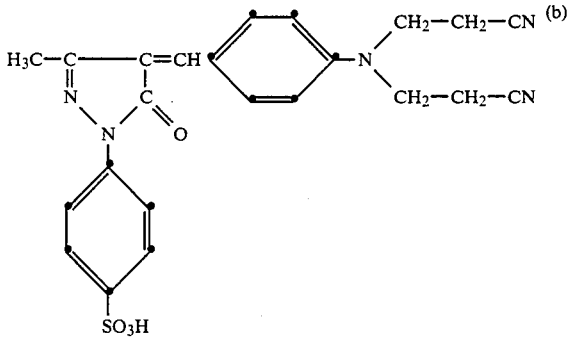

(b)

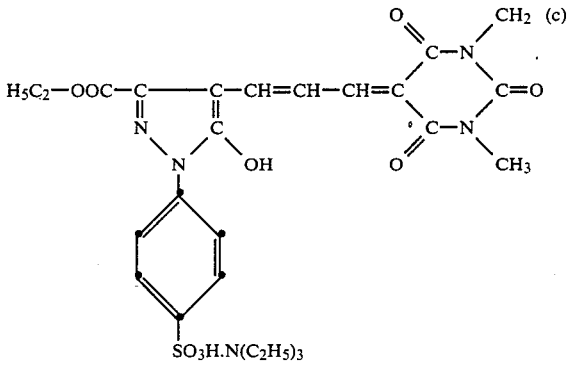

(c)

-continued

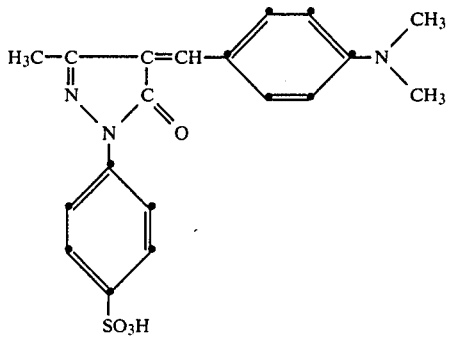

(d)

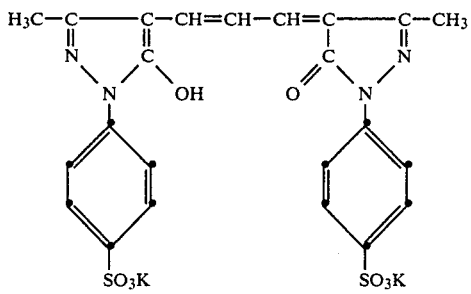

(e)

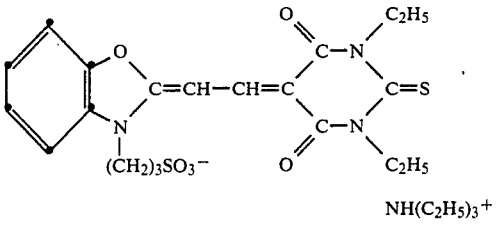

(f)

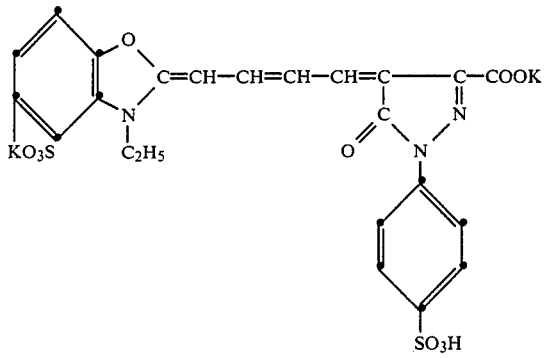

(g)

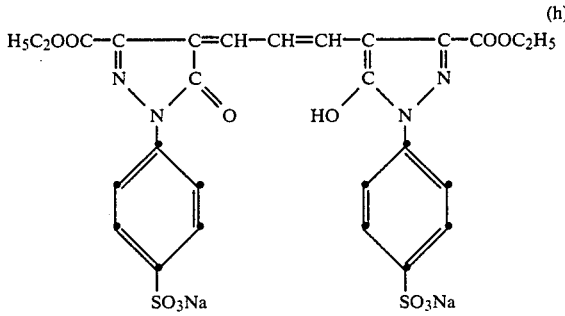

(h)

-continued (i)

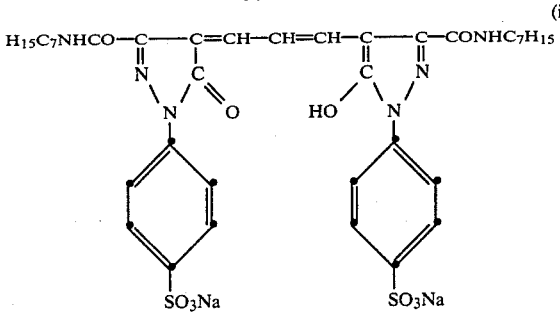

Dyes of the above reported type can be synthesized with processes known in the photographic art, as described for instance in GB Pat. No. 560,385 and in U.S. Pat. No. 1,884,035. The dyes can be chosen among those reported above according to the specific needs, the preferred dyes being those falling within general formulas (I) and (II) above.

The basic polymeric mordants useful to mordant the dyes in the hydrophilic colloidal layer between the base and the photographic emulsion layer according to the present invention comprise repeating units of formula:

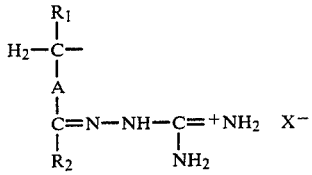

wherein $R_1$ is hydrogen or a methyl group, A is a —COO— or a —COO—alkylene group, e.g. —$COOCH_2$—, —$COOCH_2CH_2$—, —$COOCHOHCH_2$—, $R_2$ is hydrogen or a lower alkyl group having from 1 to 4 carbon atoms and X is an anion, e.g. acetate, oxalate, sulfate, chloride, bromide.

The mordants useful in the present invention can comprise units derived from copolymerizable monomers, such as acrylates, acrylamides, vinyl acetates, styrenes, vinyl-ethers, vinyl-ketones, vinyl-alchols, unsaturated chlorides and nitriles, with the proviso that such copolymer units be in such a quantity as not to modify the characteristics of the mordants useful to the purposes of the present invention; acceptable quantities are for instance up to 20% by weight, more preferably up to 10% by weight.

Mordants useful in the present invention can have mean molecular weights which may vary according to particular needs; particularly useful mean molecular weights are comprised in the range from 5,000 to 100,000.

The hydrophilic colloid layer containing the basic polymer mordant and the acid dye is a layer coated between the base and the silver halide emulsion layer. The hydrophilic colloid may be any colloid of the type generally used in the photographic elements as said above for the emulsion layer, the preferred colloid being gelatin. The layer may be either an intermediate auxiliary layer coated between the sublayer and the emulsion layer or, more preferably, the same sublayer of the base. As known, in fact, the photographic base is per se hydrophobic and needs a hydrophilic layer, viz. the sublayer, to assure sufficient adhesion of the of the light-sensitive hydrophilic layers. The use of the sublayer, which normally consists of gelatin, to contain the dye and the mordant according to the subject invention has the advantage of doing without one layer, thus allowing a lower thickness of the photographic material and shorter drying times during the photographic processing. The relative quantity of polymeric mordant to gelatin is known to affect the coatability of the gelatin coating composition including the mordant. The skilled in the art can easily find the maximum quantity of polymeric mordant which can be used according to the present invention. Generally, the weight percentage of polymeric mordants to gelatin in the layers of the present invention is in the range of 1 to 30% and preferably is in the range of 5 to 15%. The thickness of the layer containing the mordant and dye according to the present invention is the normal thickness of layers used in the photographic elements as non light-sensitive layers (such as intermediate auxiliary layers or sublayers). Generally, said thickness ranges from 0.05 to 2 micron. Within such a range, as known in the art, a lower thickness, e.g. between 0.05 to 0.5 micron, is used when the layer works as a sublayer and a higher thickness, e.g. between 1 and 2 microns, is used when the layer works as a intermediate auxiliary layer. Besides, as known to the skilled in the art, the coating techniques used to coat the sublayer, i.e. the air knife coating technique, allow thinner layers than the coating techniques used to coat the auxiliary layers, e.g. the extrusion coating technique.

The ratio of the constitutents of the layer according to the present invention can vary within the wide limits according to the particular needs and the compounds used. Generally, the polymeric mordant is used in excess with respect to the dye, for instance one part by weight of dye is combined with 5 to 10 parts of mordant.

The optical density of the layer containing the dye and mordant according to the present invention has the aim of absorbing the light emitted by the intensifying screens and therefore of avoiding or reducing the cross-over phenomenon. Of course, the higher the optical density, the better the image quality of the material, but at the same time the lower the sensitivity. Therefore, the man skilled in the art can choose the optical density according to the desired ratio between image quality and sensitivity. Particularly useful optical densities are comprised in the range from 0.04 to 1.0 read in the light of the spectral emission region of the light emitted by the screens. Within such a range, lower values of optical density allow to obtain x-ray elements having a high sensitivity and good image qualities. Higher values of optical density allow to obtain x-ray materials having a good sensitivity and high image quality. The optical density above does not consider the possible optical density of the base. As known to the man skilled in the art, this may contain in fact a dye, usually an anthraquinone blue dye as described in U.S. Pat. Nos. 3,488,195 and 3,948,664 and in GB Pat. No. 968,244, which can have an absorption in the spectral region of the light emitted by the screens. Since such a dye incorporated in the base impermeable to the photographic processing, cannot be decolorized, the quantity used and the optical density resulting therefom are very low, the latter being generally comprised in the range from 0.05 to 0.15.

Hereinbelow there are reported the formulas of mordants known in the photographic art in comparison with mordants of the present invention:

(A) Comparison

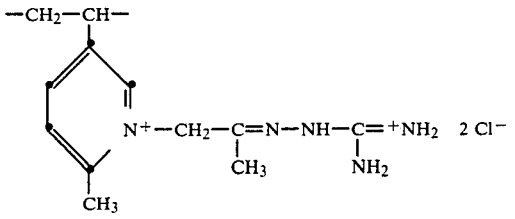

(B) Comparison

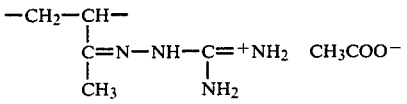

(C) Invention

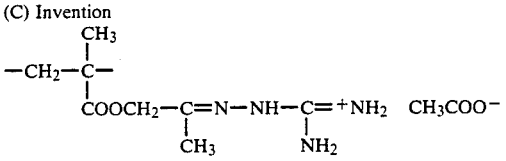

(D) Comparison

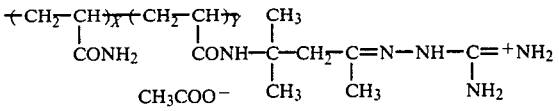

(E) Comparison

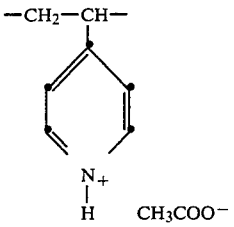

Hereinbelow there is reported a description of the polymeric mordant preparation according to the prior art and to the subject invention.

(1)

Preparation of the comparison mordant (A)

Such mordant was prepared according to the following procedure (as described in Italian Patent No. 931.270).

1.5 g of polyvinyl alcohol were dissolved in 250 ml of distilled water, boiled for 15 minutes in order to de-oxygenate it. The solution was then heated to 95° C. and, under stirring, 50 ml of 2-methyl-5-vinyl-pyridine freshly distilled and containing dissolved 2.5 g of benzoyl peroxide were added rapidly. The whole mixture was maintained under continuous stirring at 95° C. for 6 hours. Then it was left to cool. After filtering, the polymer obtained in the form of minute pellets, was washed repeatedly with cold water and then left to dry. Yield: 42 g. $[\eta]=0.14$ dl/g at 25° C. in methylethylketone. 6.2 g of poly-2-methyl-5-vinyl-pyridine obtained as hereibefore described were dissolved in 100 ml of methanol, added with 9.6 g of the guanylhydrazone of chloroacetone hydrochloride and heated at 50° C. for 5 hours. Subsequently the mixture was precipitated in acetone; the precipitate was washed twice with acetone and then it was filtered and left to dry. Yield: 14 g of water-soluble product containing per 100 g of product 85 g of the units corresponding to the formula (A).

(2)

Preparation of the comparison mordant (B)

Such mordant was prepared as described in GB Pat. No. 850,281 according to the following procedure:

Ml 360 of methylvinylketone in 360 ml of dioxane were polymerized at 100° C. for 16 hours with 9 g of azobisisobutyronitrile. The resulting polymer was isolated by precipitating the reaction mass in water and drying the precipitated polymer under vacuum. 57 g of polyvinylmethylketone dissolved in dioxane were reacted at 55° C. with 135.6 g of amino guanidine bicarbonate and with 300 ml of glacial acetic acid for 4 hours. The precipitated mordant was decanted, washed with dioxane and purified by repeatedly dissolving it in water and precipitating in acetone. 135.7 g of mordant were obtained having 83% by weight of repeating units corresponding to the formula (B).

(3)

Preparation of the invention mordant (C)

The mordant was prepared according to the following procedure.

100 g of acetone methacrylate corresponding to the formula $CH_2{=}C(CH_3){-}COOCH_2COCH_3$ in 300 ml of acetone were polymerized with 4 g of azobisisobutyronitrile at 65° C. for 6 hours. The polymer was isolated by precipitating it into ether. 66 g of the resulting polymer in 351 ml of dioxane were reacted with 95 g of amino guanidine bicarbonate and 210 ml of glacial acetic acid at 55° C. for 4 hours. The decanted mordant was washed with dioxane and purified by repeatedly dissolving it in water and precipitating in acetone. 128.8 g of mordant with 95% of weight of units corresponding to formula (C) were obtained.

(4)

Preparation of the comparison mordant (D)

Such mordant was prepared according to the following procedure.

100 g of diacetone acrylamide and 100 g of acrylamide in 1,000 ml of ethanol were copolymerized with 12.5 g of benzoyl peroxide at 80° C. for 5 hours. The polymer was isolated by precipitating the reaction mass in acetone. 82 g of the copolymer in 300 ml of dioxane and 140 ml of water were reacted with 41 g of amino guanidine bicarbonate and 90 ml of glacial acetic acid at 55° C. for 4 hours. The mordant was isolated by precipitating the reaction mass in acetone thus obtaining 99 g of mordant having 51% by weights of units having the y-index of formula (D).

(5)

Preparation of the comparison mordant (E)

The mordant was prepared according to the following procedure.

50 ml of 4-vinylpyridine in 50 ml of methyl alcohol and 50 ml of ethylacetate were polymerized at 65°-68° C. for 18 hours in the presence of 1.5 g of azobisisobutylronitrile. The mordant was isolated by precipitating the reaction mass into ethylacetate, filtering, washing with ethylacetate on the filter and drying.

As regards the processes for the silver halide emulsion preparation and the use of particular ingredients in the emulsion and in the light-sensitive element, reference is made to Research Disclosure 18,431 published in August 1979, wherein the following chapters are dealt with in deeper details:

IA. Preparation, purification and concentration methods for silver halide emulsions.
IB. Emulsion types.
IC. Crystal chemical sensitization and doping.
II. Stabilizers, antifogging and antifolding agents.
IIA. Stabilizers and/or antifoggants.
IIB. Stabilization or emulsions chemically sensitized with gold compounds.
IIC. Stabilization of emulsions containing polyalkylene oxides or plasticizers.
IID. Fog caused by metal contaminants.
IIE. Stabilization of materials comprising agents to increase the covering power.
IIF. Antifoggants for dichroic fog.
IIG. Antifoggants for hardeners and developers comprising hardeners.
IIH. Additions to minimize desensitization due to folding.
III. Antifoggants for emulsions coated on polyester bases.
IIJ. Methods to stabilize emulsions at safety lights.
IIK. Methods to stabilize x-ray materials used for high temperature. Rapid Access, roller processor transport processing.
III. Compounds and antistatic layers.
IV. Protective layers.
V. Direct positive materials.
VI. Materials for processing at room light.
VII. X-ray color materials.
VIII. Phosphors and intensifying screens.
IX. Spectral sensitization.
X. UV-sensitive materials.
XII. Bases.

EXAMPLE 1

Four special bases were prepared by coating on both surfaces of each subbed polyethylene terephthalate base (blue-colored with an anthraquinone dye and having an optical density in green light of 0.1) a gelatin layer at the coverage of 1.6 g/m$^2$ containing 0.128 g/m$^2$ of the mordant as reported in Table 1 and 0.0256 g/m$^2$ of dye (a). A fifth special base was prepared by coating on both surfaces of the subbed base a gelatin layer at the coverage of 1.6 g/m$^2$ containing 0.0128 g/m$^2$ of mordant (E) and 0.0256 g/m$^2$ of dyes (b) and (c) respectively. The optical density read in green light through a Macbeth Status A filter was measured in the films prior to and after having processed the bases for 5 minutes in water at 20° C. The residual stain of the bases processed for 90" at 35° C. in a 3M XP-507 automatic processor with a 3M XAD/2 Developer and 3M XAF/2 Fixer x-ray processing was also evaluated subjectively. Table 1 reports the obtained results.

TABLE 1

| Base | Mordant | Optical density * | Optical density ** | Optical density % | Residual stain |
|---|---|---|---|---|---|
| 1 (Comp.) | A | 0.36 | 0.24 | 33 | Bad |
| 2 (Comp.) | B | 0.44 | 0.35 | 20 | Bad |
| 3 (Inv.) | C | 0.41 | 0.40 | 2 | Good |
| 4 (Comp.) | D | 0.45 | 0.35 | 22 | Poor |
| 5 (Comp.) | E | 0.37 | 0.23 | 38 | Poor |

*Optical density prior to processing.
**Optical density after processing.

The obtained results show how the combination mordant C of the present invention and dye assures a very good anchorage of the dye in the layer and a good residual stain after the photographic processing.

EXAMPLE 2

A gelatin layer containing a silver bromo-iodide emulsion with 2.3% iodide moles and grains with a mean size of 0.7 micron, optically sensitized with a trimethinecarbocyanine up to the sensitivity maximum of about 545 nm, was coated at the silver coverage of 3 g/m$^2$ on both surfaces of the special bases 3, 4 and 5 of Example 1. Samples of the photographic films thus obtained were contacted with two terbium doped gadolinium oxysulfide 3M TRIMAX TM T8 intensifying screens emitting light above all at 544 nm and exposed to 80 kV x-rays through a shaded aluminium wedge. The samples thus exposed were developed as said above. The following table reports the sensitometric results and the residual stain of the films thus processed and the preservability of the image stored on shelf for two years.

TABLE 2

| Film | Base | D. Min | D. Max | Sens. | Contr. | Resid. stain | Image stabil. |
|---|---|---|---|---|---|---|---|
| 6 (Inv) | 3 | 0.26 | 4.10 | +0.04 | 2.7 | Good | Good |
| 7 (Comp) | 4 | 0.24 | 3.90 | −0.10 | 2.7 | Poor | Good |
| 8 (Comp) | 5 | 0.30 | 3.80 | ref. | 2.8 | Poor | Bad |

The above reported results show how an X-ray film having the emulsion layer coated on a mordanted dye layer according to the present invention gives very good results as regards the residual stain, the photographic characteristics, as well as the image stability under file storage conditions.

EXAMPLE 3

Two films were prepared by respectively coating on both surfaces of the subbed polyester base of Example 1 a gelatin layer at the coverage of 1.34 g/m$^2$, containing 0.11 g/m$^2$ of mordant (C) and 0.025 g/m$^2$ of dye (a), to obtain film 9 and a gelatin layer at the coverage of 1.34 g/m$^2$, containing 0.11 g/m$^2$ of mordant (E) and 0.02 g/m$^2$ of dyes (b) and (c) to obtain film 10. Both surfaces of the films thus obtained were coated with a gelatin layer containing a silver bromo-iodide emulsion, having 2.3% iodide moles and grains with a mean size of 0.65 micron, optically sensitized with a trimethine carbocyanine up to the maximum sensitivity of about 545 nm and a silver coverage of 2.4 g/m$^2$ per each surface. Samples of the two films were processed as said above and at the end the quantity of residual thiosulfate in the material was measured by reducing it to sulfide and quantitatively determining the sulfide in a colorimetric way with methylene blue. The following table reports the obtained values.

TABLE 3

| Film | Mordant | Residual thiosulfate |
|---|---|---|
| 9 | C | 5.9 μg/cm$^2$ |
| 10 | E | 11.4 μg/cm$^2$ |

EXAMPLE 4

A film (Film 11) was obtained by coating on both surfaces of the base of Example 1 without subbing layer a gelatin sublayer at the coverage of 0.1 g/m$^2$ containing 0.013 g/m² of mordant (C) and 0.0052 g/m² to dye (a). A second film (Film 12) was obtained by coating on both surfaces of the polyester base a gelatin sublayer at the coverage of 0.1 g/m² and on this a gelatin layer at the coverage of 1.34 g/m² containing 0.018 g/m² or mordant (C) and 0.0052 g/m² of (a). The optical density of the samples of both films was read in green light prior to and after processing with water at 20° C. for 5 minutes and in an x-ray 3M XP507 automatic processor containing the above reported processing solution. The residual stain of both films was evaluated after processing in the automatic processor. The results are reported in the following table.

TABLE 4

| Film | Optical density * | ** | *** | Residual stain |
|---|---|---|---|---|
| 11 | 0.15 | 0.14 | 0.09 | Good |
| 12 | 0.16 | 0.14 | 0.09 | Good |

*Prior to processing
**After water processing
***After automatic processing

The results show how the introduction of the mordanted dye into the sublayer coated onto the polyester base assures a very good anchorage of the dye in the layer containing it and good possibilities of decolorizing the dye.

EXAMPLE 5

Both surfaces of films 11 and 12 of Example 4 both surfaces of a film, obtained by coating a sublayer of sole gelatin at the coverage of 0.1 g/m² on both surfaces, were coated with a gelatin layer containing a silver bromoiodide emulsion sensitized as said above, thus respectively obtaining Films 13, 14 and 15. The silver bromoiodide emulsion had 2.3% iodide moles and grains with a mean size of 0.65 micron and was coated at a coverage of 2.4 g/m² per each surface. Samples of the three films were exposed as said above using 3M TRIMAX TM T2 intensifying screens, developed as said above. The following table reports the sensitometric characteristics, the MTF values, the "cross-over" value, the drying time in 3M XP507 automatic processor and the retention of thiosulfate.

TABLE 5

| Film | 13 | 14 | 15 |
|---|---|---|---|
| Dmin | 0.18 | 0.18 | 0.19 |
| Dmax | 3.65 | 3.60 | 3.60 |
| Sensitiv.* | −0.1 | −0.1 | Ref. |
| Contrast | 2.65 | 2.65 | 2.60 |
| MTF** | 50 | 50 | 40 |
| Crossover*** | 30 | 30 | 47 |
| Drying time | 70" | 76" | 70" |
| Thiosulf. ret. | 5.2 μg/cm² | 6.3 μg/cm² | 4.6 μg/cm² |

*expressed in logE
**Lines/mm
***Crossover is given as 1/antilog Δ logE% where Δ logE is the sensitivity difference between the two surfaces by exposing through a single screen on one surface only.

The results show that Film 13 has the same sensitometric characteristics and the same image quality as Film 14, but a shorter drying time in the automatic processor and a lower thiosulfate retention.

We claim:

1. A light-sensitive silver halide element for use with x-ray intensifying screens said element comprising a transparent support having coated on at least one of its sides one spectrally sensitized silver halide emulsion layer, said element containing, between the base and said one silver halide emulsion layer, a hydrophilic colloid layer of from 0.05 to 2 microns containing a water-soluble acid dye capable of being decolorized in the photographic processing and having absorption in a region of the electromagnetic spectrum corresponding to the spectral sensitivity of the silver halide emulsion, said dye being associated with a basic polymeric mordant, said mordant being present as from 1 to 30% by weight of said hydrophilic colloid, said element being characterized by the fact that said mordant comprises repeating units of formula:

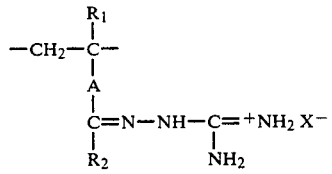

wherein $R_1$ is hydrogen or a methyl group, A is a —COO— or —COO—alkylene group, $R_2$ is hydrogen or a lower alkyl group and X is an anion.

2. The light-sensitive element of claim 1, wherein the transparent base is polyethylene terephthalate.

3. The light-sensitive element of claim 1, wherein the hydrophilic colloid layer containing the mordanted dye is an intermediate auxiliary layer.

4. The light-sensitive element of claim 1, wherein the hydrophilic colloid layer containing the mordanted dye is a subbing layer of the base.

5. The light-sensitive element of claim 1, wherein the water-soluble dye capable of being decolorized during the photographic processing has the formula:

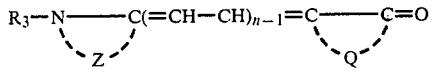

wherein $R_3$ represents a substituted or not substituted alkyl group, Z represents the non-metallic atoms necessary to complete a heterocyclic nucleus of the benzoxazole series, Q represents the non-metallic atoms necessary to complete a heterocyclic nucleus of the pyrazolinone series and n is a positive integer from 1 to 3, and has the molecule substituted with at least a sulfo, sulfoalkyl, sulfoaryl, carboxy or carboxyalkyl group.

6. The light-sensitive element of claim 1, wherein the water-soluble dye capable of being decolorized during the photographic processing has the formula:

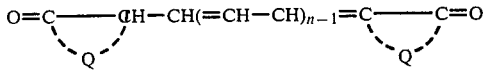

wherein Q represents the non-metallic atoms necessary to complete a heterocyclic nucleus of the pyrazolinone series and n is a positive integer from 1 to 3, and has the molecule substituted with at least a sulfo, sulfoalkyl, sulfoaryl, carboxy or carboxyalkyl group.

7. The light-sensitive element of claim 1, wherein the total silver coverage is comprised in the range from about 3 to about 6 grams per square meter.

8. The light-sensitive element of claim 1, wherein the optical density, read at the wavelength of the spectral sensitization light, of the hydrophilic colloid layer containing the mordanted dye is comprised in the range between about 0.04 and 1.00.

9. The light-sensitive element of claim 1, wherein the silver halide emulsion layer is spectrally sensitized to the green light of the visible spectrum.

10. The light-sensitive element of claim 9, wherein the water-soluble dye capable of being decolorized during the photographic processing has the formula:

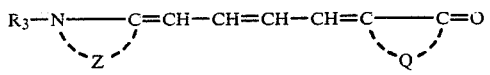

wherein $R_3$ represents a substituted or not substituted alkyl group, Z represents the non-metallic atoms necessary to complete a heterocyclic nucleus of the benzoxazole series, Q represents the non-metallic atoms necessary to complete a heterocyclic nucleus of the pyrazolinone series, and has the molecule substituted with at least a sulfo, sulfoalkyl, sulfoaryl, carboxy or carboxyalkyl group.

11. The light-sensitive element of claim 9, wherein the water-soluble dye capable of being decolorized during the photographic processing has the formula:

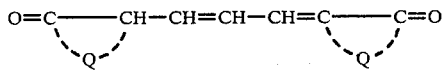

wherein Q represents the non-metallic atoms necessary to complete a heterocyclic nucleus of the pyrazolinone series, and has the molecule substituted with at least one sulfo, sulfoalkyl, sulfoaryl, carboxy or carboxyalkyl group.

12. A light-sensitive silver halide element for use with x-ray intensifying screens said element comprising a transparent support having coated on at least one of its sides one spectrally sensitized silver halide emulsion layer, said element containing, between the base and said one silver halide emulsion layer, a hydrophilic colloid layer of from 0.05 to 2 microns containing a water-soluble acid dye capable of being decolorized in the photographic processing and having absorption in a region of the electromagnetic spectrum corresponding to the spectral sensitivity of the silver halide emulsion, said dye being present in sufficient concentration to provide an optical density capable of reducing crossover, said dye being associated with a basic polymeric mordant, said mordant being present as from 1 to 30% by weight of said hydrophilic colloid, said element being characterized by the fact that said mordant comprises repeating units of formula:

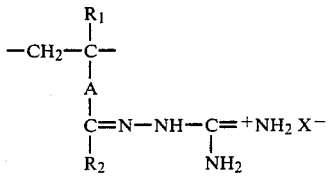

wherein $R_1$ is hydrogen or a methyl group, A is a —COO— or —COO—alkylene group, $R_2$ is hydrogen or a lower alkyl group and X is an anion.

13. The element of claim 12 wherein said dye is present in a weight ratio of one part dye to five to ten parts of mordant.

* * * * *